United States Patent [19]

Wise

[11] Patent Number: 4,466,432

[45] Date of Patent: Aug. 21, 1984

[54] AIR SUPPLYING HOOD

[75] Inventor: Layton A. Wise, Washington, Pa.

[73] Assignee: Mine Safety Appliances Co., Pittsburgh, Pa.

[21] Appl. No.: 302,736

[22] Filed: Sep. 16, 1981

[51] Int. Cl.[3] ..... A62B 17/04

[52] U.S. Cl. ..... 128/201.23; 128/201.25; 128/201.29; 128/202.19; 2/410; 2/171.3

[58] Field of Search ..... 128/202.19, 205.26, 128/DIG. 20, 201.22–201.29; 52/2; 2/205, 410, 424, 171.3; 135/20 B

[56] References Cited

U.S. PATENT DOCUMENTS

| | | | |
|---|---|---|---|
| 645,286 | 3/1900 | Bader | 128/201.23 |
| 1,113,675 | 10/1914 | Morgan | 128/201.25 |
| 2,156,852 | 5/1939 | Horak | 2/424 |
| 2,240,751 | 5/1941 | Boesger | 128/201.23 |
| 2,296,338 | 9/1942 | Dakin | 128/201.23 |
| 2,529,106 | 11/1950 | Schauweker | 128/201.25 |
| 2,651,302 | 9/1953 | Berry | 128/DIG. 20 |
| 2,978,708 | 4/1961 | Williams et al. | 2/410 |
| 3,145,719 | 8/1964 | Johnson | 52/2 |
| 3,156,471 | 11/1964 | Bibeau | 52/2 |
| 3,241,269 | 3/1966 | Reffell | 52/2 |
| 3,710,791 | 1/1973 | Deaton | 128/205.26 |
| 3,863,661 | 2/1975 | Aburto | 135/20 B |
| 4,127,130 | 11/1978 | Naysmith | 128/201.25 |
| 4,207,883 | 6/1980 | Shindler | 128/201.22 |
| 4,331,141 | 5/1982 | Pokhis | 128/201.25 |

*Primary Examiner*—Richard J. Apley
*Assistant Examiner*—Harry J. Macey
*Attorney, Agent, or Firm*—Carothers & Carothers

[57] ABSTRACT

An air supplying hood has a top wall, to which the upper edge of a flexible plastic front wall is connected, with the upper portion of the front wall forming a transversely curved front window. A flexible back wall behind the window is connected with the top wall and the sides of the window to form with the window an open-bottom enclosure for a person's head. The lower portion of the flexible back wall and the front wall below the window form areas shaped to fit over a person's shoulder and lie against his chest and back. Above those areas is a hollow band extending around the hood and communicating with the lower ends of circumferentially spaced hollow vertical struts with which the wall of the head enclosure is provided. The band and struts are inflatable by an air tube extending through the back wall for supplying air to the head enclosure.

4 Claims, 9 Drawing Figures

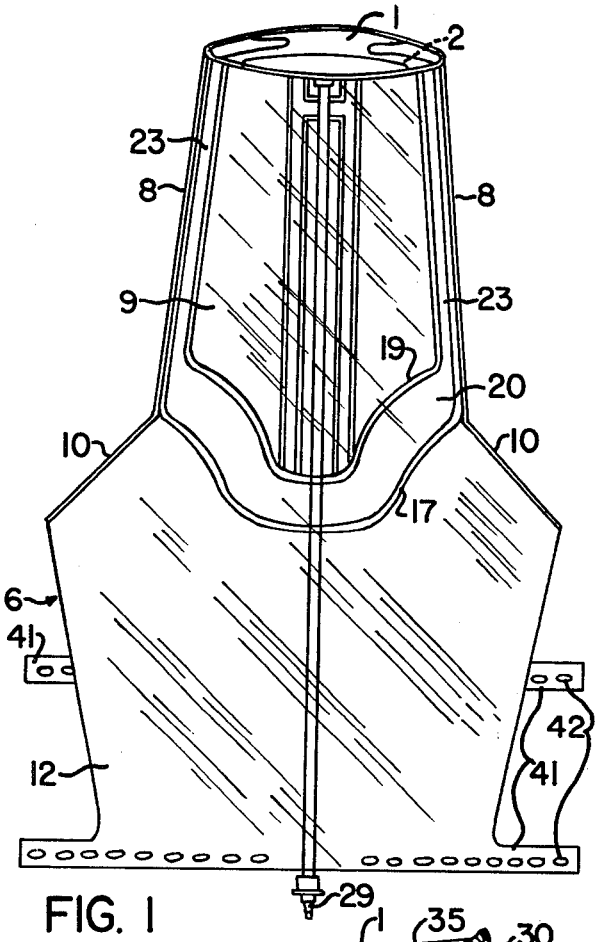
FIG. 1
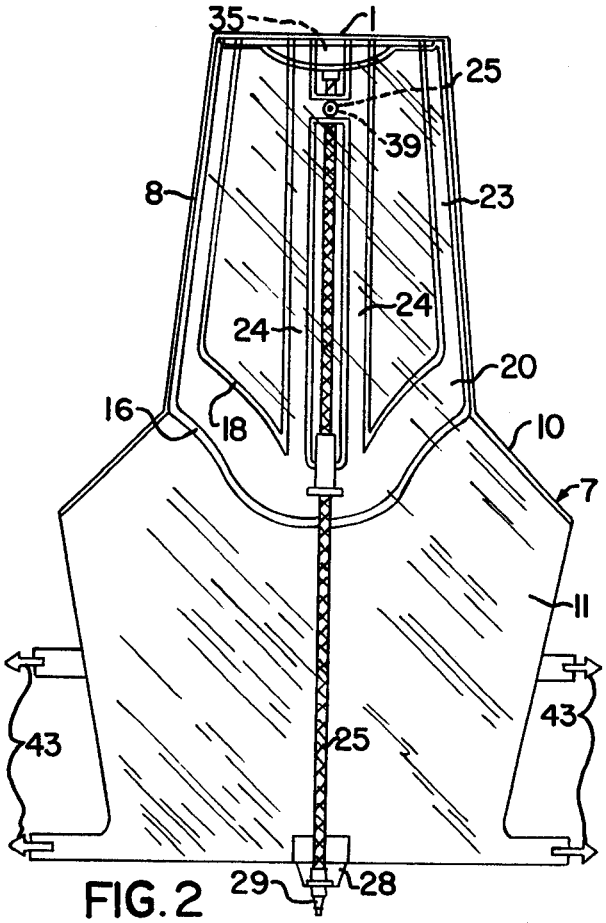
FIG. 2
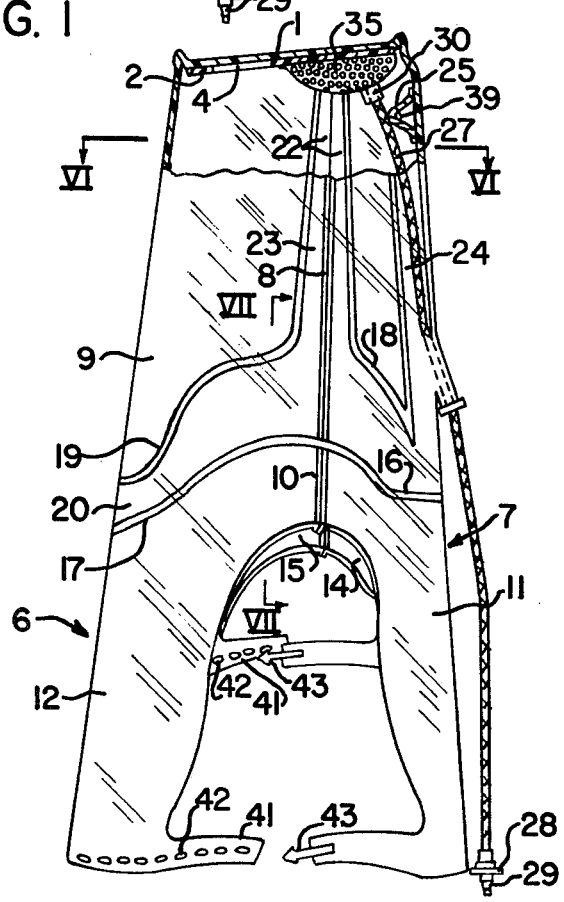
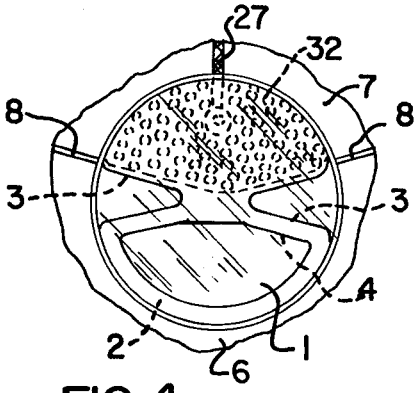
FIG. 4

AIR SUPPLYING HOOD

It sometimes is necessary for a person to work in an area where the air, for some reason or other, is not suitable for breathing. In such cases the workman may wear a hood that completely encloses his head and to which a continuous stream of fresh air is delivered through a hose from a breathable air source. Such a hood is shown, for example, in U.S. Pat. No. 4,207,883, in which means also is disclosed for reducing the objectionable sound of the incoming fresh air.

It is among the objects of this invention to provide an air-receiving hood which is made principally of highly flexible material, which includes inflatable means for stiffening the head enclosure and spacing the top of the hood from the head, which has an inflatable band around the bottom of the head enclosure to stabilize the hood on the workman, which provides good visibility in all directions, and the bottom of which can be strapped around the chest and back or around the waist.

The preferred embodiment of the invention is illustrated in the accompanying drawings, in which FIG. 1 is a front view of the hood;

FIG. 2 is a rear view;

FIG. 3 is a side view;

FIG. 4 is a view of the top of the hood;

DETAILED DESCRIPTION OF THE DRAWINGS

Figure 5:
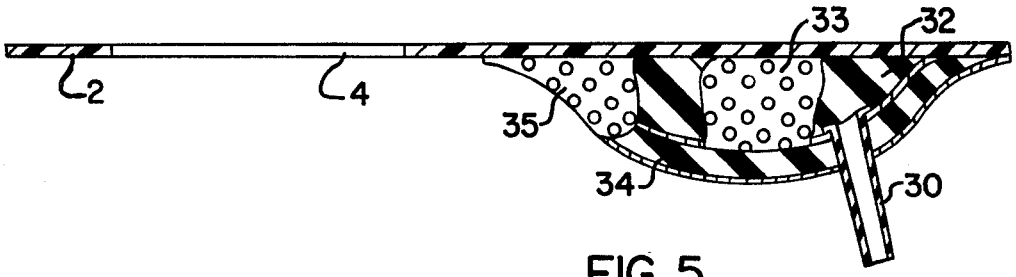
FIG. 5 is an enlarged vertical section taken on the line V—V of FIG. 4 but showing only the sound muffler.
Figure 6:
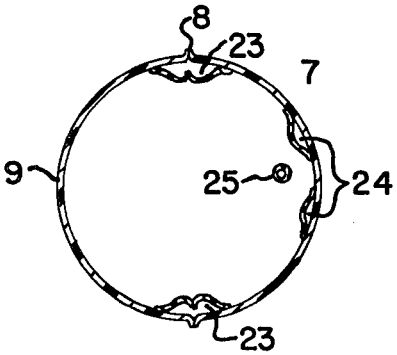
FIG. 6 is a cross section taken on the line VI—VI of FIG. 3.
Figure 7:
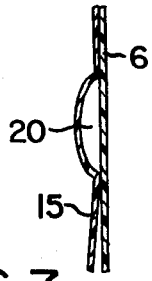
FIG. 7 is a fragmentary vertical section taken on the line VII—VII of FIG. 3.

Referring to FIG. 4 of the drawings, the top wall of the hood is formed from a circular sheet 1 of transparent plastic resting on a flat rigid circular support 2 that also is transparent plastic. This support has a pair of diametrically opposite V-shape recesses 3 in its sides so that the support has front and rear sections integrally connected at the center between the recesses. The rear section is solid, but the front section has a large opening 4 in it to provide better visibility for the wearer when he looks through the top wall.

Secured to the edge of the top wall and suspended from it are two sheets of flexible transparent plastic. The front sheet 6 is wider than the rear sheet 7. Their meeting vertical edges are sealed together along seams 8 extending downwardly from about the front corners of the solid rear section of the top wall support 2 to form an open-bottom head enclosure as shown in FIGS. 1, 2 and 3. The front sheet forms a large transversely curved window 9. The vertical seams extend down far enough to reach a man's shoulders when the top of the hood is spaced above his head, and the seams continue downwardly and outwardly as shown at 10 so that the hood will fit over the shoulders. The lower portion of the back wall and the portion of the front wall below the window form areas 11 and 12, respectively, for overlapping the wearer's back and chest. The lower edges of these areas are provided with adjustable straps that will be described presently, to pull the bottom of the hood in against the body below the shoulders.

The areas 11 and 12 of the hood are provided with liners or inner layers 14 and 15 made from flexible sheets of plastic that are sealed together directly below the shoulder seams 10 as shown in FIG. 3. These inner sheets are sealed to the outer layer along seams 16 and 17 that extend from the upper ends of the shoulder seams downwardly and across the back and chest areas. The major portions of the upper edges of the inner sheets are also sealed to the outer layer along seams 18 and 19 roughly parallel to seams 16 and 17 to form a hollow band 20 extending around the hood. The inner sheets are shorter than the outer sheets, as shown in FIG. 3.

The inner sheets also have narrow side strips 22 extending from band 20 up to the top wall of the hood and sealed together along their meeting edges as shown in FIG. 3. The remaining edges of the side strips are sealed to the front and back walls of the hood to form hollow vertical struts 23 at the opposite sides of the window. At the back of the head enclosure, as shown in FIG. 2, a pair of laterally spaced hollow struts 24 are formed by extending two strips of the inner layer upwardly from band 20 to the top wall and sealing their edges to the outer layer that forms the back wall 7 of the head enclosure. The lower ends of all four struts open into the top of the hollow band. Near their upper ends, the strips forming the two back struts are integrally connected by a cross strip 25 that has its upper and lower edges sealed to the back wall so that the rear struts are in communication with each other in that area.

In order to deliver a stream of breathable air to the inside of the hood, the back wall 7 between the lower ends of the rear struts 24 is provided with an opening that snugly receives a flexible air hose 27. The lower outer end of the hose extends through a hole in a tab 28 secured to the bottom of the hood. The hose is provided with a connection 29 for joining it to another hose (not shown) connected to a source of compressed breathable air. Inside the hood the hose extends upwardly and into an extension formed by a sleeve 30 mounted in a noise reducer or muffler.

As shown in FIGS. 3, 4 and 5, this muffler is secured to the lower surface of the solid rear portion of the top wall support 2. The muffler includes an upper body 32 of open cell plastic foam held against the bottom of support 2 by an upper sheet 33 of perforated material, such as flexible plastic, secured to the support around the plastic foam. A lower body 34 of open cell plastic foam is held up against this perforated sheet by a lower sheet 35 of perforated material secured at its edges to support 2. The two perforated sheets and the lower body of plastic foam are provided with aligned openings, in which the sleeve 30 is mounted, with its upper end opening into the upper foam body. The incoming air stream will spread out in the upper foam body, be distributed through the perforations in the upper sheet 33, spread out in the lower foam body and issue into the head enclosure through the perforated lower sheet. The velocity of the entering air is thus reduced and it enters the hood quietly.

The air hose is provided with a side opening beside the cross strip 25 that is between the two rear struts. This opening is fitted with a nipple 39 that fits snugly in a hole in the cross strip. There is a very small passage through the nipple, through which air from the hose enters the rear struts and flows from them down into band 20 and from the band up into the side struts. The air pressure thus produced in the struts and band inflates them and makes the struts stiff enough to support the top wall of the hood above the head so that the workman can freely turn his head inside the hood. The inflated band encircling the hood stabilizes it relative to the man so that it will not shift out of position during his movements. This stability is enhanced by the way the hood fits over the shoulders.

The straps at the bottom of the hood are formed by extending the lower marginal areas of the different layers of the hood laterally. They can be reinforced by flexible plastic strips secured to them. The ends of two of the straps 41 are provided with longitudinally spaced slots 42 for receiving "arrowhead" projections 43 on the other two straps.

To use the hood, the workman puts it over his head and pulls the chest and back areas down in place. He then fastens the front and rear straps of the inner liners together to draw the bottom of the hood in against his body in the chest area. Then he puts on his work suit, the upper portion of which will cover the inner layers of the hood below band 20. Finally, he fastens together the front and rear straps of the longer outer layer of the hood to draw it in around his waist.

Figure 8:
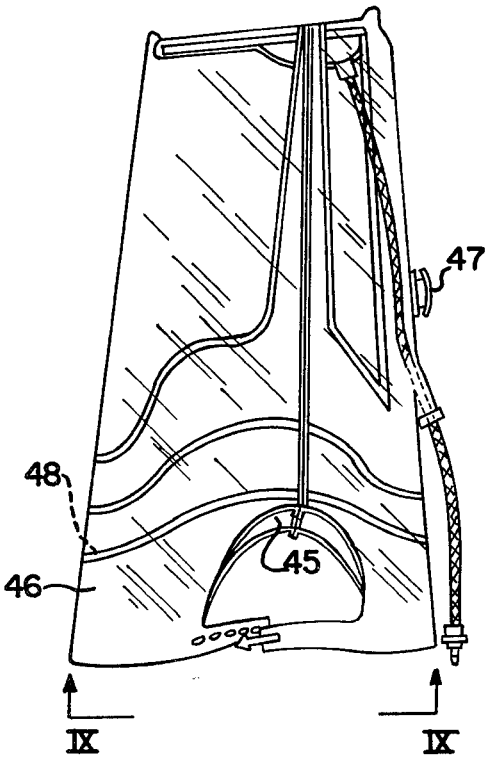
FIG. 8 is a side view of a modification.
Figure 9:
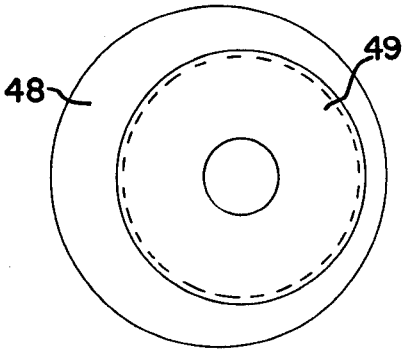
FIG. 9 is a bottom view of the collar sealed inside the hood of FIG. 8.

In a modification shown in FIG. 8, both the inner layer 45 of the hood and its outer layer 46 are substantially the same length as the inner layer 14/15 shown in FIG. 3 and one set of bottom straps is provided instead of two. The air supplied to the first embodiment of these hoods escapes out of the bottom of the head enclosure, but if, as shown in FIGS. 8 and 9, the hood is provided inside the head enclosure with a substantially air-impervious collar secured at its outer edge to the surrounding wall, the back wall of the hood is provided with a conventional check valve 47 to permit the air to escape from the hood. The collar is formed from a plastic ring 48 sealed to the inner layer of the hood below the inflatable band. The opening in the ring is large enough to allow the ring to be pulled down over a man's head. Secured to the inner margin of the ring is a smaller ring 49 of stretchable fabric, the inner diameter of which is small enough to snugly engage the workman's neck so that when the hood is in use the bottom of the head enclosure is more or less sealed.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An air supplying hood comprising a top wall, a flexible plastic front wall connected at its upper edge with the top wall, the upper portion of the front wall forming a transversely curved front window, a flexible back wall behind the window connected with the top wall and the sides of the window to thereby form with the window an open-bottom enclosure for a person's head, the lower portion of the flexible back wall and the front wall below the window forming areas shaped to fit over a person's shoulders and lie against his chest and back, the walls of said enclosure being provided with a plurality of circumferentially spaced hollow vertical struts closed at their upper ends, a hollow band extending around the hood at the upper end of said areas and in fluid flow communication with the lower ends of the struts, said band and struts being inflatable to stiffen them, inflation means for inflating said band and struts, an air tube extending through said back wall for supplying air to said head enclosure, said back wall provided with an opening admitting said tube to the head enclosure, and said inflation means comprising said tube having a lateral opening in fluid communication with the inside of at least one of said struts to inflate the struts and band, said tube further in fluid flow communication with an air muffler provided within the head enclosure downstream of said lateral opening wherein the air muffler discharges air from said tube to the head enclosure.

2. An air supplying hood according to claim 1, in which said struts and band are formed by a flexible layer of air-impervious material sealed to the adjoining enclosure wall along the edges of the struts and band.

3. An air supplying hood comprising a top wall, a flexible plastic front wall connected at its upper edge with the top wall, the upper portion of the front wall forming a transversely curved front window, a flexible back wall behind the window connected with the top wall and the sides of the window to thereby form with the window an open-bottom enclosure for a person's head, the lower portion of the flexible back wall and the front wall below the window forming areas shaped to fit over a person's shoulders and lie against his chest and back, the walls of said enclosure being provided with a plurality of circumferentially spaced hollow vertical struts closed at their upper ends, a hollow band extending around the hood at the upper end of said areas and in fluid flow communication with the lower ends of the struts, said band and struts being inflatable to stiffen them, inflation means for inflating said band and struts, an air tube extending through said back wall for supplying air to said head enclosure, said back wall provided with an opening admitting said tube to the head enclosure, and said inflation means comprising said tube having a lateral opening in fluid flow communication with the inside of at least one of said struts to inflate the struts and band, said tube further in fluid flow communication with an air muffler provided within the head enclosure downstream of said lateral opening wherein the air muffler discharges air from said tube to the head enclosure, the air muffler comprising a solid upper wall held against the back portion of said top wall, an upper body of open cell plastic foam engaging the lower surface of said upper wall, an upper sheet of perforated material enclosing said foam body and secured at its edges to said upper wall, a lower body of open cell plastic foam engaging the lower surface of said perforated sheet, and a lower sheet of perforated material enclosing said lower foam body and secured at its edges to said upper wall, said perforated sheets and said lower body being provided with a passage therethrough, and the upper end of said air tube extending through said passage to deliver air to said upper body.

4. An air supplying hood according to claim 3, in which the portion of said top wall in front of said muffler is transparent.

* * * * *